US008709208B2

(12) United States Patent
Zhao et al.

(10) Patent No.: US 8,709,208 B2
(45) **Date of Patent: *Apr. 29, 2014**

(54) METHOD TO INCREASE DEWATERING, SHEET WET WEB STRENGTH AND WET STRENGTH IN PAPERMAKING

(75) Inventors: Yulin Zhao, Shanghai (CN); Jun Li, Shanghai (CN); Qing Long Rao, Shanghai (CN); Weiguo Cheng, Naperville, IL (US)

(73) Assignee: Nalco Company, Naperville, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/480,998

(22) Filed: May 25, 2012

(65) Prior Publication Data

US 2013/0306261 A1 Nov. 21, 2013

Related U.S. Application Data

(63) Continuation-in-part of application No. 12/727,299, filed on Mar. 19, 2010, which is a continuation-in-part of application No. 11/854,044, filed on Sep. 12, 2007, now Pat. No. 8,172,983.

(30) Foreign Application Priority Data

May 15, 2012 (CN) ..... 2012 1 0150534

(51) Int. Cl.
*D21H 11/00* (2006.01)

(52) U.S. Cl.
USPC ..... 162/164.5

(58) Field of Classification Search
None
See application file for complete search history.

(56) References Cited

U.S. PATENT DOCUMENTS

| | | | | |
|---|---|---|---|---|
| 3,556,932 | A * | 1/1971 | Coscia | 162/166 |
| 4,605,702 | A | 8/1986 | Guerro et al. | |
| 7,125,469 | B2 | 10/2006 | Barcus et al. | |
| 7,211,608 | B2 | 5/2007 | Niinikoski et al. | |
| 7,615,135 | B2 | 11/2009 | Harrington et al. | |
| 7,641,776 | B2 | 1/2010 | Nagar et al. | |
| 8,088,213 | B2 | 1/2012 | Cheng et al. | |
| 2005/0161181 | A1 | 7/2005 | St. John et al. | |
| 2009/0020250 | A1 * | 1/2009 | Kimura et al. | 162/164.6 |
| 2009/0065162 | A1 * | 3/2009 | Cheng et al. | 162/164.3 |
| 2010/0126684 | A1 * | 5/2010 | Cheng et al. | 162/162 |

* cited by examiner

*Primary Examiner* — Mark Halpern
(74) *Attorney, Agent, or Firm* — Benjamin E. Carlsen

(57) ABSTRACT

The invention provides a method of improving dewatering efficiency, increasing sheet wet web strength, increasing sheet wet strength and enhancing filler retention in a papermaking process. The method improves the efficiency of dewatering aid by coating at least some of the filler particles with a material that prevents the filler materials form adhering to dewatering aids. The dewatering aid holds the paper fibers together tightly and is not wasted on the filler particles.

14 Claims, 1 Drawing Sheet

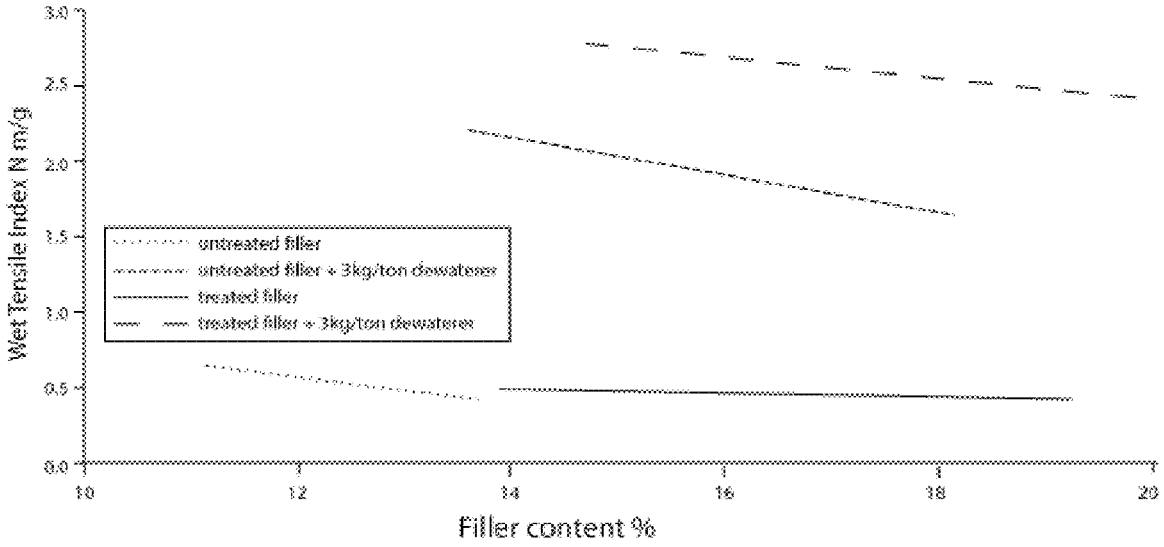
Wet Tensile Index N m/g
3.0
2.5
2.0
1.5
1.0
0.5
0.0
10
12
14
16
18
20
Filler content %
untreated filler
untreated filler + 3kg/ton dewatering
treated filler
treated filler + 3kg/ton dewatering

METHOD TO INCREASE DEWATERING, SHEET WET WEB STRENGTH AND WET STRENGTH IN PAPERMAKING

CROSS-REFERENCE TO RELATED APPLICATIONS

This is a continuation in part application of U.S. patent application Ser. No. 12/727,299 filed on Mar. 19, 2010 which in turn is a continuation in part application of U.S. application Ser. No. 11/854,044 filed on Sep. 12, 2007 and which has issued as U.S. Pat. No. 8,172,983 on May 8, 2012.

STATEMENT REGARDING FEDERALLY SPONSORED RESEARCH OR DEVELOPMENT

Not Applicable.

BACKGROUND OF THE INVENTION

This invention relates to a method of improving dewatering efficiency, increasing sheet wet web strength, increasing sheet wet strength and enhancing filler retention in a papermaking process. Typically in a papermaking process chemicals are added in the wet end to assist in the dewatering of the slurry and improving wet or dry sheet strength. The wet end of the papermaking process refers to the stage in the papermaking process where the fiber is dispersed in the water in the slurry form. The fiber-water slurry then goes through drainage and dewatering process to form a wet web. The solid content after this wet formation process is about 50%. The wet web is further dried and forms a dry sheet of paper mat. Paper mat comprises water and solids and commonly 4 to 8% water. The solid portion of the paper mat includes fibers (typically cellulose based fibers) and can also include filler.

Fillers are mineral particles that are added to paper mat during the papermaking process to enhance the resulting paper's opacity and light reflecting properties. Some examples of fillers are described in U.S. Pat. No. 7,211,608. Fillers include inorganic and organic particles or pigments used to increase the opacity or brightness, or reduce the cost of the paper or paperboard sheet. Some examples of fillers include one or more of kaolin clay, talc, titanium dioxide, alumina trihydrate, barium sulfate, magnesium hydroxide, pigments such as calcium carbonate, and the like.

Calcium carbonate filler comes in two forms, GCC (ground calcium carbonate) and PCC (precipitated calcium carbonate). GCC is naturally occurring calcium carbonate rock and PCC is synthetically produced calcium carbonate. Because it has a greater specific surface area, PCC has greater light scattering abilities and provides better optical properties to the resulting paper. For the same reason however, PCC filled paper is weaker than GCC filled paper in dry strength, wet strength and wet web strength. Filler is generally much smaller than fiber, therefore, filler has much larger specific surface area than fiber. One of the challenges people found to increase filler content in the sheet is that high filler content decreases the efficiency of wet end chemicals, such as dewatering aids. This invention is to provide novel filler preflocculation, so that it reduced the adsorption of wet end chemicals onto filler surface, therefore, increased the efficiency of wet end chemicals such as dewatering aids.

Paper wet web strength is the tensile strength of a never dried sheet. Paper wet web strength is very critical for paper producers because increased paper wet web strength would increase machine runnability and reduce sheet breaks and machine down time. Paper wet web strength is a function of the number and the strength of the bonds formed between interweaved fibers of the paper mat. Filler particles with greater surface area are more likely to become engaged to those fibers and interfere with the number and strength of those bonds. Because of its greater surface area, PCC filler interferes with those bonds more than GCC.

Paper dewatering efficiency is also very critical for paper producers because decreased dewatering efficiency in wet end would increase steam demand for drying operation, reduce machine speed and production efficiency. Dewatering aids are widely used to improve dewatering efficiency for reducing energy consumption, increasing machine speed and production efficiency.

Paper wet strength is the tensile strength of the sheet when it is re-wet. Paper wet strength is not only one of important sheet properties, but also important for machine runnability for fine papermachine with a size press. Sheet gets re-wet after size press, and tends to break if the sheet wet web strength is low. Same as paper dry strength and wet web strength, paper wet strength decreases with the filler content in the sheet due to filler interference with fiber-fiber bonding.

Thus there is clear need and utility in methods and compositions for improving dewatering efficiency, increasing sheet wet web strength, increasing sheet wet strength and enhancing filler retention in a papermaking process. The art described in this section is not intended to constitute an admission that any patent, publication or other information referred to herein is "prior art" with respect to this invention, unless specifically designated as such. In addition, this section should not be construed to mean that a search has been made or that no other pertinent information as defined in 37 CFR §1.56(a) exists.

BRIEF SUMMARY OF THE INVENTION

At least one embodiment of the invention is directed towards a method of papermaking having improved sheet wet strength or wet web strength or increased drainage through combining filler preflocculation and dewatering aid. The method comprises the steps of adding a first flocculating agent to an aqueous dispersion in an amount sufficient to mix uniformly in the dispersion without causing significant flocculation of the filler particles, adding a second flocculating agent to the dispersion after adding the first flocculating agent in an amount sufficient to initiate flocculation of the filler particles in the presence of the first flocculating agent, the second flocculating agent being of opposite charge to the first flocculant, combining the filler particles with the paper fiber stock, treating the combination with at least one dewatering aid, and forming a paper mat by removing some of the water from the combination. The cellulose fiber stock comprises a plurality of cellulose fibers and water. The second flocculating agent inhibits dewatering aid from adhering to the filler particles.

At least one embodiment of the invention is directed towards a method in which the dewatering of the paper made by the papermaking process is increased by an amount greater than the sum of the dewatering enhancement provided by the preflocculation process using the first and second flocculation agents and the dewatering agent if they were added separately.

At least one embodiment of the invention is directed towards a method in which filler particles further comprises one item selected from the list consisting of: calcium carbonate, organic pigment, inorganic pigment, clay, talc, titanium dioxide, alumina trihydrate, barium sulfate, magnesium hydroxide, and any combination thereof. The method may further comprise the step of shearing the dispersion to obtain a predetermined floc size. The filler flocs may have a median particle size of 10-200 μm. The first flocculating agent may be anionic and amphoteric. The dewatering agent may be glyoxylated Acrylamide/Diallyl-Dimethyl-Ammonium-Chloride (AcAm/DADMAC) copolymer or Diallylamine/Acrylamide (DAA/AcAm) copolymer or polyvinylamine (PVAM) resin. The ratio of dewatering aid relative to the solid portion of the paper mat can be 0.3 to 10 kg of additive per ton of paper mat. The first flocculation agent may be a copolymer of acrylamide and sodium acrylate. The dewatering aid and the second flocculating agent may carry the same charge.

The second flocculating agent may be selected from the list consisting of consisting of copolymers of acrylamide with DMAEM, DMAEA, DEAEA, DEAEM. The second flocculating agent may be in quaternary ammonium salt form made with a salt selected from the list consisting of dimethyl sulfate, methyl chloride, benzyl chloride, and any combination thereof. The filler may be anionically dispersed and a low molecular weight, cationic coagulant is added to the dispersion to at least partially neutralize its anionic charge prior to the addition of the first flocculating agent. The second flocculating agent may have a charge, which is opposite to the charge of the first flocculating agent. The filler flocs may have a median particle size of 10-200 μm. The blend of filler particles further comprises one item selected from the list consisting of: calcium carbonate, organic pigment, inorganic pigment, clay, talc, titanium dioxide, alumina trihydrate, barium sulfate, magnesium hydroxide, and any combination thereof. The low molecular weight composition may be a cationic coagulant, the first flocculating agent may be an anionic flocculent, the second flocculating agent may be a cationic flocculent, and both flocculants may have a molecular weight of at least 1,000,000.

BRIEF DESCRIPTION OF THE DRAWING

A detailed description of the invention is hereafter described with specific reference being made to the drawings in which:

FIG. 1 is a graph showing the improved wet strength of paper made according to the invention.

DETAILED DESCRIPTION OF THE INVENTION

The following definitions are provided to determine how terms used in this application, and in particular how the claims, are to be construed. The organization of the definitions is for convenience only and is not intended to limit any of the definitions to any particular category.

"Coagulant" means a composition of matter having a higher charge density and lower molecular weight than a flocculant, which when added to a liquid containing finely divided suspended particles, destabilizes and aggregates the solids through the mechanism of ionic charge neutralization.

"Dewatering Aid" means chemical additives that will improve the dewatering of the paper web, at any point in the process. This means that a material might not affect free drainage, but have a significant effect on vacuum drainage or pressing response.

"DAA" means diallylamine.

"DADMAC" means diallyl dimethyl ammonium chloride.

"DMAEM" means dimethylaminoethylmethacrylate as described and defined in U.S. Pat. No. 5,338,816.

"DMAEA" means dimethylaminoethylacrylate as described and defined in U.S. Pat. No. 5,338,816.

"DEAEA" means diethylaminoethyl acrylate as described and defined in U.S. Pat. No. 6,733,674.

"DEAEM" means diethylaminoethyl methacrylate as described and defined in U.S. Pat. No. 6,733,674.

"Flocculant" means a composition of matter having a low charge density and a high molecular weight (in excess of 1,000,000) which when added to a liquid containing finely divided suspended particles, destabilizes and aggregates the solids through the mechanism of interparticle bridging.

"Flocculating Agent" means composition of matter that when added to a liquid, destabilizes and aggregates colloidal and finely divided suspended particles in liquid into flocs.

Flocculants suitable for the invention generally have molecular weights in excess of 1,000,000 and often in excess of 5,000,000.

The polymeric flocculant is typically prepared by vinyl addition polymerization of one or more cationic, anionic or nonionic monomers, by copolymerization of one or more cationic monomers with one or more nonionic monomers, by copolymerization of one or more anionic monomers with one or more nonionic monomers, by copolymerization of one or more cationic monomers with one or more anionic monomers and optionally one or more nonionic monomers to produce an amphoteric polymer or by polymerization of one or more zwitterionic monomers and optionally one or more nonionic monomers to form a zwitterionic polymer. One or more zwitterionic monomers and optionally one or more nonionic monomers may also be copolymerized with one or more anionic or cationic monomers to impart cationic or anionic charge to the zwitterionic polymer. Suitable flocculants generally have a charge content of less than 80 mole percent and often less than 40 mole percent.

While cationic polymer flocculants may be formed using cationic monomers, it is also possible to react certain nonionic vinyl addition polymers to produce cationically charged polymers. Polymers of this type include those prepared through the reaction of polyacrylamide with dimethylamine and formaldehyde to produce a Mannich derivative.

Similarly, while anionic polymer flocculants may be formed using anionic monomers, it is also possible to modify certain nonionic vinyl addition polymers to form anionically charged polymers. Polymers of this type include, for example, those prepared by the hydrolysis of polyacrylamide.

The flocculant may be prepared in the solid form, as an aqueous solution, as a water-in-oil emulsion, or as a dispersion in water. Representative cationic polymers include copolymers and terpolymers of (meth)acrylamide with dimethylaminoethyl methacrylate (DMAEM), dimethylaminoethyl acrylate (DMAEA), diethylaminoethyl acrylate (DEAEA), diethylaminoethyl methacrylate (DEAEM) or their quaternary ammonium forms made with dimethyl sulfate, methyl chloride or benzyl chloride. Representative anionic polymers include copolymers of acrylamide with sodium acrylate and/or 2-acrylamido 2-methylpropane sulfonic acid (AMPS) or an acrylamide homopolymer that has been hydrolyzed to convert a portion of the acrylamide groups to acrylic acid.

"GCC" means ground calcium carbonate, which is manufactured by grinding naturally occurring calcium carbonate rock "Papermaking Process" means a method of making paper and paperboard products from pulp comprising mixing the pulp with water which forms an aqueous cellulosic paper mat, draining the mat to form a sheet, and drying the sheet. It should be appreciated that any suitable paper mat may be used. Representative paper mats include, for example, an aqueous cellulosic slurry containing virgin pulp, recycled pulp, kraft pulp (bleached and unbleached), sulfite pulp, mechanical pulp, polymeric plastic fibers, the like, and any combination of the foregoing pulps. The steps of forming the paper mat draining and drying may be carried out in any manner generally known to those skilled in the art.

"PCC" means precipitated calcium carbonate which is synthetically produced.

"Preflocculation" means the modification of filler particles into agglomerates through treatment with a particular flocculating agent prior to the addition of those filler particles into the paper mat, the flocculating agent is selected on the basis of the size distribution and stability of the floc that the flocculating agent will form.

"PVAM" means polyvinylamine resins.

"Runnability" means the degree to which a sheet of paper or paper precursor passes trouble free through the various stages and pieces of equipment in a papermaking process, such troubles include but is not limited to jamming, clogging, or fouling equipment, damaging equipment, and/or requiring more energy to pass the sheet of paper or paper precursor through the equipment.

In the event that the above definitions or a description stated elsewhere in this application is inconsistent with a meaning (explicit or implicit) which is commonly used, in a dictionary, or stated in a source incorporated by reference into this application, the application and the claim terms in particular are understood to be construed according to the definition or description in this application, and not according to the common definition, dictionary definition, or the definition that was incorporated by reference. In light of the above, in the event that a term can only be understood if it is construed by a dictionary, if the term is defined by the Kirk-Othmer Encyclopedia of Chemical Technology, 5th Edition, (2005), (Published by Wiley, John & Sons, Inc.) this definition shall control how the term is to be defined in the claims.

At least one embodiment of the invention is a method of making paper, which is strong, has a high filler content, and has superior optical properties. In at least one embodiment of the invention the method of papermaking comprises the steps of providing filler material, pre-treating at least some of the filler material by preflocculation leading to a decrease in the adsorption of a dewatering aid on the filler material, and adding both the preflocculated filler blend and the dewatering aid to the paper mat.

Preflocculation is a process in which, material is treated by two flocculating agents in a manner that optimizes the size distribution and stability of the flocs under a particular shear force prior to its addition to the paper stock. The particular chemical environment and high fluid shear rates present in modern high-speed papermaking require filler flocs to be stable and shear resistant. Examples of preflocculation methods applicable to this invention are described in US Published Application 2009/0065162 A1 and U.S. application Ser. No. 12/431,356.

It has been known for some time that adding dewatering aid to paper mat increases the wet web strength of the resulting paper or enhances drainage or improves machine speed and runnability or enhance sheet wet strength. Some examples of wet strength aids, wet web strength additives and drainage aids are described in U.S. Pat. Nos. 7,125,469, 7,615,135 and 7,641,776.

Unfortunately it is not practical to add large amounts of dewatering aid to compensate for the weakness that results from using large amounts of filler in paper mat. One reason is because dewatering aids are expensive and using large amounts of additives would result in production costs that are commercially non-viable. In addition, adding too much dewatering aid negatively affects the process of papermaking and inhibits the operability of various forms of papermaking equipment. Furthermore cellulose fibers can only adsorb a limited amount of dewatering aid. This imposes a limit on how much additive can be used. One reason why this is because dewatering aid tends to neutralize the anionic fiber/filler charges and when these charges are neutralized further adsorption of those additives is inhibited.

Adding filler to the paper mat reduces the effectiveness of the dewatering aid. Because filler has a much higher specific surface area than fiber, most of the dewatering aid added into the papermaking slurry goes to filler surfaces, and therefore there is less dewatering aid available to bind the cellulose fibers together. This effect is more acute with PCC compared to GCC because PCC has a much higher surface area and is able to adsorb more dewatering aid.

In at least one embodiment the dewatering efficiency, sheet wet web strength, sheet wet strength and filler retention is increased by the following method: An aqueous dispersion of filler materials is formed and the filler materials are preflocculated before being added to a paper fiber stock. A first flocculating agent is added to the dispersion in an amount sufficient to mix uniformly in the dispersion without causing significant flocculation of the filler particles. A second flocculating agent is then added following the first flocculating agent, in an amount sufficient to initiate flocculation of the filler material in the presence of the first flocculating agent, the second flocculating agent being of opposite charge to the first flocculating agent. A paper mat is formed by combining the preflocculated filler material with the fiber stock and treating this combination with the dewatering aid. The preflocculation of the filler material enhances the performance of the dewatering aid. The fiber stock comprises fibers, fillers, and water.

In at least one embodiment, the fibers are predominantly cellulose based. In at least one embodiment the flocculated dispersion is sheared to obtain a particularly desired particle size.

While pre-treating filler particles is known in the art, prior art methods of pre-treating filler particles are not directed towards affecting the adhesion of the dewatering aid to the filler particles with two flocculants. In fact, many prior art pre-treatments increase the adhesion of the strength additive to the filler particles. For example, U.S. Pat. No. 7,211,608 describes a method of pre-treating filler particles with hydrophobic polymers. This pre-treatment however does nothing to the adhesion between the dewatering aid and the filler particles and merely repels water to counterbalance an excess of water absorbed by the dewatering aid. In contrast, the invention decreases the interactions between the dewatering aid and the filler particles and results in an unexpectedly huge increase in the dewatering efficiency, sheet wet web strength, sheet wet strength and filler retention, sheet dewatering and machine runnability. This can best be appreciated by reference to FIG. 1.

FIG. 1 illustrates that a paper produced from a paper mate that includes PCC filler tends to become weaker as more PCC filler is added. When a large amount of PCC is added (over 20%), the addition of a dewatering aid adds little wet strength to the paper. Paper made from preflocculated PCC filler combined with a dewatering additive however increases the wet strength to a degree that it is stronger than paper having 10% less PCC that is not preflocculated. As a result, at least two conclusions can be reached, 1) the dewatering aid is more effective in increasing sheet wet strength or wet web strength or increased drainage with preflocculated filler than with untreated filler and 2) there is a synergistic effect from the combination of dewatering aid and filler preflocculation which makes it superior to the additive effects of the sum of the dewatering aid alone plus the filler preflocculation alone. As a result, preflocculation of the PCC filler material leads to improvement of efficiency of dewatering aids.

At least some of the fillers encompassed by this invention are well known and commercially available. They include any inorganic or organic particle or pigment used to increase the opacity or brightness, reduce the porosity, or reduce the cost of the paper or paperboard sheet. The most common fillers are calcium carbonate and clay. However, talc, titanium dioxide, alumina trihydrate, barium sulfate, and magnesium hydroxide are also suitable fillers. Calcium carbonate includes ground calcium carbonate (GCC) in a dry or dispersed slurry form, chalk, precipitated calcium carbonate (PCC) of any morphology, and precipitated calcium carbonate in a dispersed slurry form. The dispersed slurry forms of GCC or PCC are typically produced using polyacrylic acid polymer dispersants or sodium polyphosphate dispersants. Each of these dispersants imparts a significant anionic charge to the calcium carbonate particles. Kaolin clay slurries also are dispersed using polyacrylic acid polymers or sodium polyphosphate.

In at least one embodiment the runnability issues caused by the high filler content is ameliorated by the addition of a dewatering aid to the paper mat. It is known in general that dewatering aids assist in addressing runnability issues. However in the prior art dewatering aids were not typically used in conjunction with high levels of filler because fillers also reduce the effectiveness of dewatering aids.

Without limitation to theory and in particular the scope of the claims, it is believed that the reason why filler impairs dewatering aids is because the filler particles absorb dewatering agent leaving less of such agents available to assist the papermaking process. In at least one embodiment the preflocculation of the filler particles is done in conjunction with the use of a de-watering aid without unduly (or at all) reducing the effectiveness of the de-watering aid. The pre-flocculation reduces the available surface area of the filler particles available to interact with the de-watering aids and thereby leaves the de-watering aid available to assist in the papermaking process. This allows the high levels of filler particles to be used in the papermaking process but it also allows the dewatering aid to improve process runnability.

In at least one embodiment, the dewatering aid carries the same charge as the second flocculating agent for treating the filler particles. When the two carry the same charge, the filler additive is less likely to adsorb wet strength aid, wet web strength additive or drainage aid on its surface. Dewatering aids encompassed by the invention include any one of the compositions of matter described in U.S. Pat. No. 4,605,702 and US Patent Application 2005/0161181 A1 and in particular the various glyoxylated Acrylamide/DADMAC copolymer compositions described therein. An example of a glyoxylated Acrylamide/DADMAC copolymer composition is Nalco 63700 (available from Nalco Company, Naperville, Ill., 60563). Other examples are amine-containing polymers including Dallylamine/acrylamide (DAA/AcAm) copolymers and polyvinylamines (PVAM).

In at least one embodiment, the fillers used are PCC, GCC, and/or kaolin clay. In at least one embodiment, the fillers used are PCC, GCC, and/or kaolin clay with polyacrylic acid polymer dispersants or their blends. The ratio of dewatering aid relative to solid paper mat can be 3 kg of additive per ton of paper mat.

EXAMPLES

The foregoing may be better understood by reference to the following examples, which are presented for purposes of illustration and are not intended to limit the scope of the invention.

A Paper mat was prepared by disintegrating commercial bleached hardwood dry lap. The filler material preflocculation was performed with the dual flocculants approach described in example 14 of U.S. application Ser. No. 12/431,356. PCC was added to the paper mat to achieve different filler content in the sheet. 200 ppm of a commercial flocculant (Nalco 61067) was used as a retention aid. During handsheet preparation, 3 kg/ton dewatering aid (Nalco 63700) was added. The wet strength as then measured. As shown in FIG. 1, the absence of the dewatering aid resulted in various process/runnability issues that caused the paper to have impaired wet strength. Filler preflocculation caused some improvement but preflocculation combined with dewatering caused significant improvements in wet strength.

While this invention may be embodied in many different forms, there described in detail herein specific preferred embodiments of the invention. The present disclosure is an exemplification of the principles of the invention and is not intended to limit the invention to the particular embodiments illustrated. All patents, patent applications, scientific papers, and any other referenced materials mentioned herein or mentioned within any mentioned reference, are incorporated by reference in their entirety. Furthermore, the invention encompasses any possible combination of some or all of the various embodiments described herein and/or incorporated herein. In addition the invention encompasses any possible combination that also specifically excludes any one or some of the various embodiments described herein and/or incorporated herein.

The above disclosure is intended to be illustrative and not exhaustive. This description will suggest many variations and alternatives to one of ordinary skill in this art. All these alternatives and variations are intended to be included within the scope of the claims where the term "comprising" means "including, but not limited to". Those familiar with the art may recognize other equivalents to the specific embodiments described herein which equivalents are also intended to be encompassed by the claims.

All ranges and parameters disclosed herein are understood to encompass any and all subranges subsumed therein, and every number between the endpoints. For example, a stated range of "1 to 10" should be considered to include any and all subranges between (and inclusive of) the minimum value of 1 and the maximum value of 10; that is, all subranges beginning with a minimum value of 1 or more, (e.g. 1 to 6.1), and ending with a maximum value of 10 or less, (e.g. 2.3 to 9.4, 3 to 8, 4 to 7), and finally to each number 1, 2, 3, 4, 5, 6, 7, 8, 9, and 10 contained within the range.

This completes the description of the preferred and alternate embodiments of the invention. Those skilled in the art may recognize other equivalents to the specific embodiment described herein which equivalents are intended to be encompassed by the claims attached hereto.

The invention claimed is:

1. A method of papermaking comprising filler, the method comprising the steps of:

providing an aqueous dispersion of filler particles, at least one dewatering aid and cellulose fiber stock, adding a first flocculating agent to an aqueous dispersion of filler particles in an amount sufficient to mix uniformly in the dispersion without causing significant flocculation of the filler particles, adding a second flocculating agent to the dispersion after adding the first flocculating agent in an amount sufficient to initiate flocculation of the filler particles in the presence of the first flocculating agent, the second flocculating agent being of opposite charge to the first flocculant, combining the filler particles with the paper fiber stock, treating the combination with at least one dewatering aid selected from the group consisting of synthetic dewatering additives, and forming a paper mat from the combination, the paper fiber stock comprises a plurality of fibers and water, and the filler pre-flocculation enhances the performance of the dewatering aid in the paper mat.

2. The method of claim 1 in which the dewatering efficiency, sheet wet web strength, sheet wet strength and filler retention is increased by an amount greater than the sum of: the dewatering efficiency, sheet wet web strength, sheet wet strength and filler retention enhancement provided by the preflocculation process and the dewatering aids, if they were applied separately.

3. The method of claim 1 wherein the filler is selected from the group consisting of calcium carbonate, kaolin clay, talc, titanium dioxide, alumina trihydrate, barium sulfate, and magnesium hydroxide.

4. The method of claim 1 in which paper fiber is cellulose fiber.

5. The method of claim 1 further comprising the step of shearing the dispersion to obtain a predetermined floc size of between 10 and 200 microns.

6. The method of claim 1 wherein the first flocculating agent is anionic or amphoteric.

7. The method of claim 1 wherein the first flocculating agent is a copolymer of acrylamide and sodium acrylate.

8. The method of claim 1 in which the second flocculating agent has a charge, which is opposite to the charge of the first flocculating agent.

9. The method of claim 1 wherein the second flocculating agent is selected from the list consisting of copolymers of acrylamide with DMAEM, DMAEA, DEAEA, DEAEM.

10. The method of claim 9 in which the second flocculating agent is in quaternary ammonium salt form made with a salt selected from the list consisting of dimethyl sulfate, methyl chloride, benzyl chloride, and any combination thereof.

11. The method of claim 1 wherein the ratio of the first flocculating agent to the filler is between 0.2 and 4 kg flocculating agent per ton filler and the ratio of the second flocculating agent to the filler is between 0.2 and 4 kg flocculating agent per ton filler.

12. The method of claim 1 in which the dewatering aid and the second flocculating agent carry the same charge.

13. The method of claim 1 wherein the filler is anionically dispersed and a low molecular weight, cationic coagulant is added to the dispersion to at least partially neutralize its anionic charge prior to the addition of the first flocculating agent.

14. The method of claim 13 wherein the low molecular weight composition is a cationic coagulant, the first flocculating agent is an anionic flocculant, the second flocculating agent is a cationic flocculent, and both flocculating agents have a molecular weight of at least 1,000,000.

* * * * *